US005748837A

United States Patent [19]

Lokar et al.

[11] Patent Number: 5,748,837

[45] Date of Patent: May 5, 1998

[54] HIGH TEMPERATURE LAMP HEATER ASSEMBLY WITH COOLING OF LAMP BASE PORTIONS

[75] Inventors: Richard A. Lokar, Orwell; Dennis J. Rezabek, Thompson, both of Ohio

[73] Assignee: Process Technology Inc, Mentor, Ohio

[21] Appl. No.: 823,133

[22] Filed: Mar. 24, 1997

[51] Int. Cl.[6] ..... H05B 1/00; H01R 33/02

[52] U.S. Cl. ..... 392/411; 392/407; 219/537; 362/294; 362/218; 439/235

[58] Field of Search ..... 392/411, 415, 392/418, 416, 407, 408; 219/553, 411, 536–537; 250/504 R; 313/110, 112; 439/227, 229, 230, 235, 242; 362/218

[56] References Cited

U.S. PATENT DOCUMENTS

| | | | |
|---|---|---|---|
| 2,099,610 | 11/1937 | Ledder | 439/206 |
| 2,176,657 | 10/1939 | Finch | 313/21 |
| 3,005,081 | 10/1961 | Kordes et al. | 392/411 |
| 3,188,459 | 6/1965 | Bridwell | 392/418 |
| 3,843,879 | 10/1974 | Eddy | 362/218 |
| 3,944,807 | 3/1976 | Frantti et al. | 362/217 |
| 4,596,433 | 6/1986 | Oesterheld et al. | 439/206 |
| 4,780,799 | 10/1988 | Groh | 362/294 |
| 4,963,694 | 10/1990 | Alexion et al. | 174/15.6 |
| 5,054,107 | 10/1991 | Batchelder | 392/483 |
| 5,351,166 | 9/1994 | Kang | 361/690 |
| 5,458,505 | 10/1995 | Prager | 439/485 |
| 5,590,240 | 12/1996 | Rezabek | 392/483 |

*Primary Examiner*—John A. Jeffery

[57] ABSTRACT

A heater assembly for supporting and energizing a plurality of heating lamps which includes a socket assembly which supports each of the lamps at a base portion thereof, provides power to effect energization of the lamps, and provides a directional flow of cooling fluid which is forced into close proximity to the base portions of the lamps to effect cooling of the base portions of each of the lamps. The cooling fluid is directed into a manifold disposed in the socket assembly in which each of the base portions of the lamps are disposed and is forced from the manifold through exit passageways disposed contiguous to the base portions of the lamps to force the cooling fluid into close proximity with the base portions of the lamps to efficiently cool the base portion of the lamp and assure long lamp life.

19 Claims, 4 Drawing Sheets

HIGH TEMPERATURE LAMP HEATER ASSEMBLY WITH COOLING OF LAMP BASE PORTIONS

DESCRIPTION—TECHNICAL FIELD

The present invention relates to a high temperature lamp heater assembly and more particularly to a heater assembly which utilizes quartz halogen infrared lamps which includes means for cooling the lamp ends or base portions of the quartz halogen infrared lamp to prevent premature failure of the lamp due to excess heat build up at the lamp ends.

BACKGROUND OF THE INVENTION

It is well known that the operation of a quartz halogen infrared lamp requires a quartz envelope temperature in excess of 250 degrees Centigrade to initiate and maintain the halogen-tungsten filament cycle while the material considerations used in the construction of the lamp limit the lamp base temperatures to 350 degrees Centigrade. In practice, some known multiple lamp arrangements generate operating temperatures in excess of 600 degrees Centigrade with resultant base temperatures well above the 350 degrees Centigrade limit. The result is untimely lamp failure, often in as quick as a few minutes.

The thermally sensitive portion of a quartz halogen infrared heating lamp, as is illustrated in FIG. 10 which discloses the construction of a typical quartz halogen infrared lamp, is known to be the thin electrical conductor imbedded in the quartz socket portion of the lamp to conduct power from an outside supply to the sealed tungsten filament. This thin electrical conductor, which is imbedded in the quartz must have a temperature coefficient of expansion equal to the coefficient of expansion of the quartz so that little or no stress is exerted on either the conductor or the quartz as the lamp temperature increases during operation. The conductor must also be thin to be sealable for the exclusion of air entry and the retention of halogen gas within the quartz lamp envelope.

Heat is transferred to this thin electrical conductor via radiation (infrared energy), conduction (the hot filament connected to the thin conductor), and convection (heat transferred from the heated surroundings). The conducted energy emanating from the 2,500 degree Centigrade filament can be removed through supplemental lamp end cooling. Since this energy is conducted from the hot filament via the inner lead wire, the length of the inner lead wire will affect the amount of energy transferred via conduction to the thin conductor located in the socket portion of the lamp. It is known to mount quartz halogen infrared lamps in a fashion such that the socket portion of the lamps extend away from the lamp reflector housing. This method of mounting coupled with lamps which utilize an extended internal filament connector wire, commonly referred to as an extended inner lead wire, as is illustrated in the right socket portion of the lamp illustrated in FIG. 10, can provide adequate cooling to yield a reasonable lamp base temperature. Other known designs, such as that illustrated in U.S. Pat. No. 5,054,107, utilize both water and forced air cooling and describes the use of using unheated process fluid in lieu of cooling water to cool the socket portion of the heater. The prior art structures fail to provide a simple low cost structure which includes adequate cooling for multiple lamps with short inner lead wires, due to lack of directional control of the cooling fluid and cooling considerations for the electrical connections needed to power the infrared lamps.

SUMMARY OF THE INVENTION

The present invention provides a new and improved heater assembly for supporting and energizing a plurality of heating lamps each of which includes a lamp portion and a socket portion having one end which is connected to a power conductor including a socket assembly having first and second side plates which are connected together to define a manifold therebetween with the first and second side plates each including a plurality of openings for receiving a base portion of a lamp therein. Each of the openings in the first side plate are aligned with an opening in the second side plate to allow the base portion of each of the lamps to pass through an opening in the first side plate and an aligned opening in the second side plate with the one end of the base portion supported adjacent the second side plate. Each of the openings in the first side plate have a cross-sectional configuration which is substantially identical and equal in size to the cross-sectional configuration of the portion of the base portion which is disposed therein to support in part the heating lamp. The openings in the second side plate have a cross-sectional configuration which is similar to and larger in area than the cross-sectional configuration of the base portion which is disposed therein, the difference in the cross-sectional area of the portion of the base portion of the lamp which is located in the opening and the cross-sectional area of the openings in the second side plate providing exit passageways from the manifold. An inlet is provided for directing a source of cooling fluid to the manifold to cool the base portions of the heating lamp located in the manifold. The cooling fluid flows from the manifold around the base portions of the heating lamps located in the manifold and through the exit passageways in the openings in the second side plates in forced proximity to the base portion to further cool the base portions of the lamps. Electrical conductor means are connected to the one end of each of the base portions of the heating lamps adjacent to the second side plate.

Another provision of the present invention is to provide a heater assembly for supporting and energizing a heating lamp which includes a lamp portion and a base portion having one end which is connected to a power conductor including a socket assembly having first and second side plates which are connected together to define a manifold therebetween. The first and second side plates each include an opening therein for receiving the base portion of the lamp. The opening in the first side plate is aligned with the opening in the second side plate to allow the base portion of the lamp to pass through and be supported in the opening in the first side plate and the aligned opening in second side plate with the one end of the base portion disposed adjacent to the second side plate. The opening in the first side plate has a cross-sectional configuration which is substantially identical and equal in size to the cross-sectional configuration of the portion of the base portion which is disposed therein to in part support the lamp and the opening in the second side plate has a cross-sectional configuration which is similar to and larger than the cross-sectional configuration of the base portion which is disposed therein with the difference in the cross-sectional area of the base portion of the lamp located in the opening and the cross-sectional area of the opening in the second side plate providing an exit passageway from the manifold. An inlet is provided for directing a source of cooling fluid into the manifold to cool the base portion of the lamp located in the manifold with the cooling fluid flowing from the manifold around the base portion of the heating lamp and through the exit passageway in the opening in the second side plate in forced proximity to the base portion of the lamp to further cool the base portion. An electrical conductor is connected to the one end of the base portion of the heating lamp adjacent the second side plate.

BRIEF DESCRIPTION OF THE DRAWINGS

FIG. 9 is a schematic diagram schematically illustrating a control system which can be utilized with the heater assembly of the present invention.

DESCRIPTION OF THE PREFERRED EMBODIMENT

Figure 1:
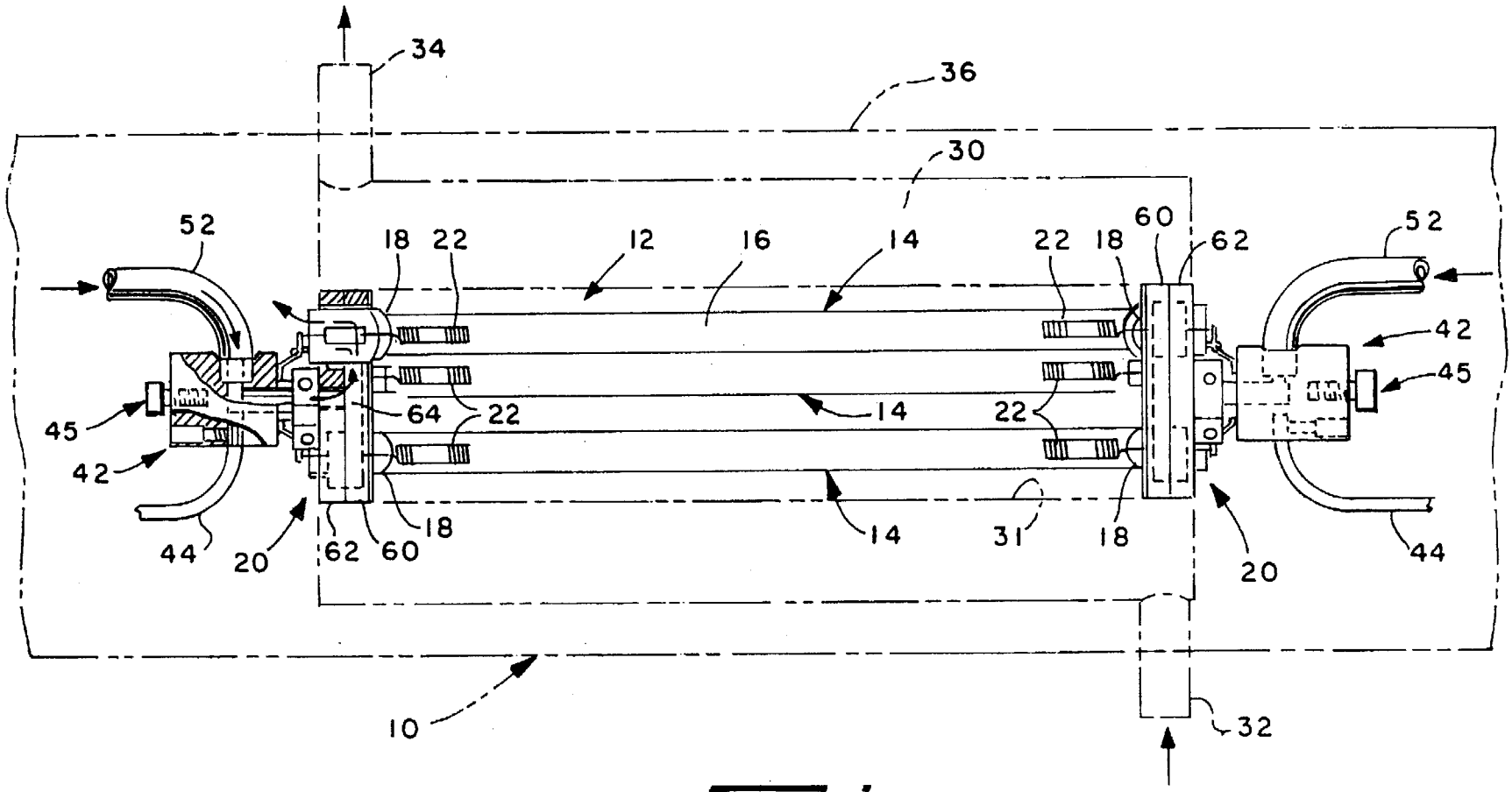
FIG. 1 is a side view of a heater assembly constructed in accordance with the present invention.
Figure 2:
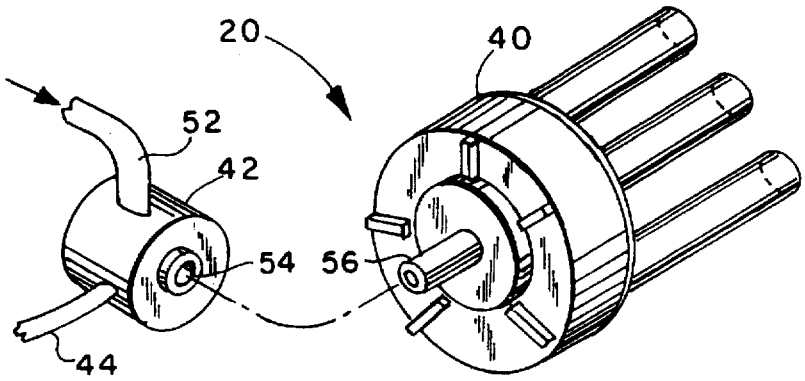
FIG. 2 is a perspective view of the socket assembly and the connector member in a disengaged position.
Figure 10:
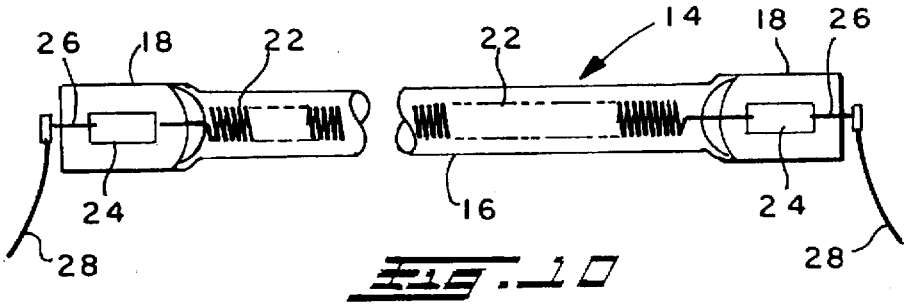
FIG. 10 is a schematic illustration of a quartz halogen infrared lamp which can be utilized in the present heater assembly.
Figure 6:
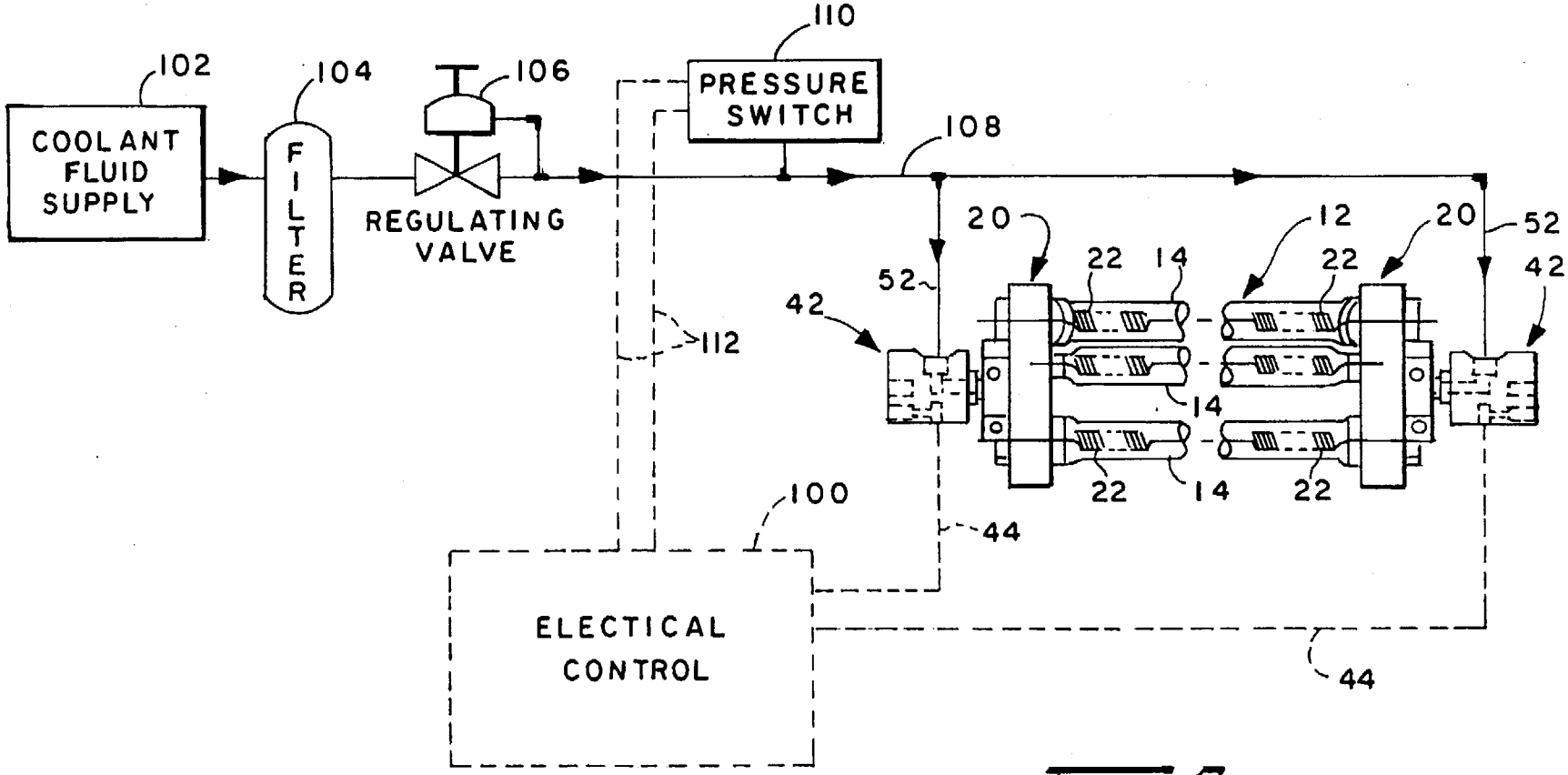

Referring to the figures and more particularly to FIGS. 1 and 10, a heater 10 constructed in accordance with the present invention is illustrated. The heater 10 includes a heater assembly 12 for supporting a plurality of heating lamps 14 therein. The heating lamps are preferably quartz halogen infrared lamps, although other types of heating lamps could be utilized. Each of the lamps 14 include a lamp portion 16 and a pair of base portions 18 at each end which are supported in base assemblies 20. While the preferred embodiment illustrates heater assembly 12 which supports five lamps 14, it should be appreciated that a single lamp 14 or a larger number of lamps 14 can be utilized in the heater assembly 12. Each of the quartz halogen infrared lamps 14, one of which is illustrated in FIG. 10, includes the lamp portion 16 which includes the tungsten filaments 22 supported therein and a base portion 18 disposed at each end of the lamp portion 16. Each of the base portions 18 include the thin conductor 24 disposed therein and include a lead 26 to which a suitable power conductor 28 can be connected to effect energization of the lamp 14.

An annular heating chamber 30 is disposed around the heater assembly 12. The annular heating chamber 30 can, in the preferred embodiment, be constructed from an inert material such as quartz to prevent contamination of any fluid passing through the annular heating chamber 30. The heating chamber 30 includes an inlet 32 and an outlet 34. Fluid is directed into the inlet 32 and to the heating chamber 30 where the fluid is heated by the heater assembly 12 and the heated fluid then passes from the outlet 34. The annular heating chamber 30 further includes a cylindrical passageway 31 disposed therein which receives and supports the heater assembly 12 therein. The heater 10 of the present invention is particularly adapted for heating ultra pure fluids for use in the semiconductor industry. The use of a quartz material in the heating chamber 30 prevents contamination of the ultra pure fluid and the chamber 30 provides for the separation of the fluid to be heated from the heater assembly 12. A suitable housing 36 can be located around the heating chamber 30 and heater assembly 12 to support the heater assembly 12 and heating chamber 30 and to reduce ambient temperature rise due to lost heat. The housing 36 can be insulated to further reduce heat loss from the housing 36 to the ambient surroundings and increases the efficiency of the heater 10. As will be more fully explained hereinafter, when the halogen infrared lamps 14 are energized, heat is transferred to the fluid in the heating chamber primarily by radiation via the infrared energy generated by lamps 14 and convection, although heat is also transferred to the fluid in chamber 30 by conduction.

Each of the base portions 18 of the lamps 14 is supported by one of the socket assemblies 20. The socket assembly 20 more fully illustrated in FIGS. 2–6 includes a socket 40 and a connector member 42. The socket 40 supports the base portion 18 of the lamps 14 and the connector member 42 which provides power thereto to effect energization of the lamps 14 and provides a source of cooling fluid such as air or inert gas which can be directed to the socket 40 to cool the base portions 18 of the quartz halogen infrared lamps 14.

Figure 3:
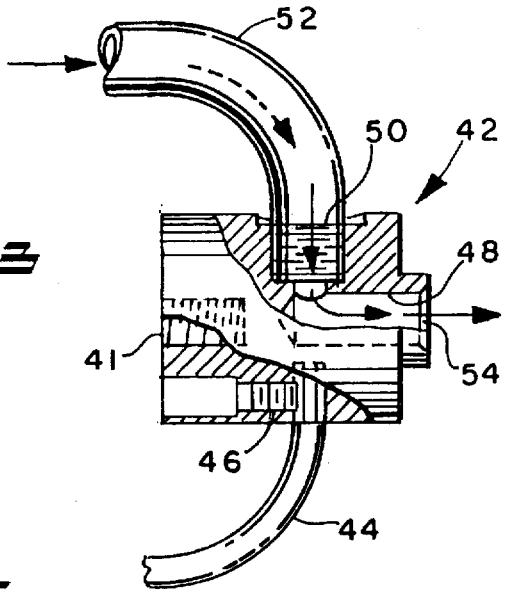
FIG. 3 is a cross-sectional side view more fully illustrating the connector member.
Figure 4:
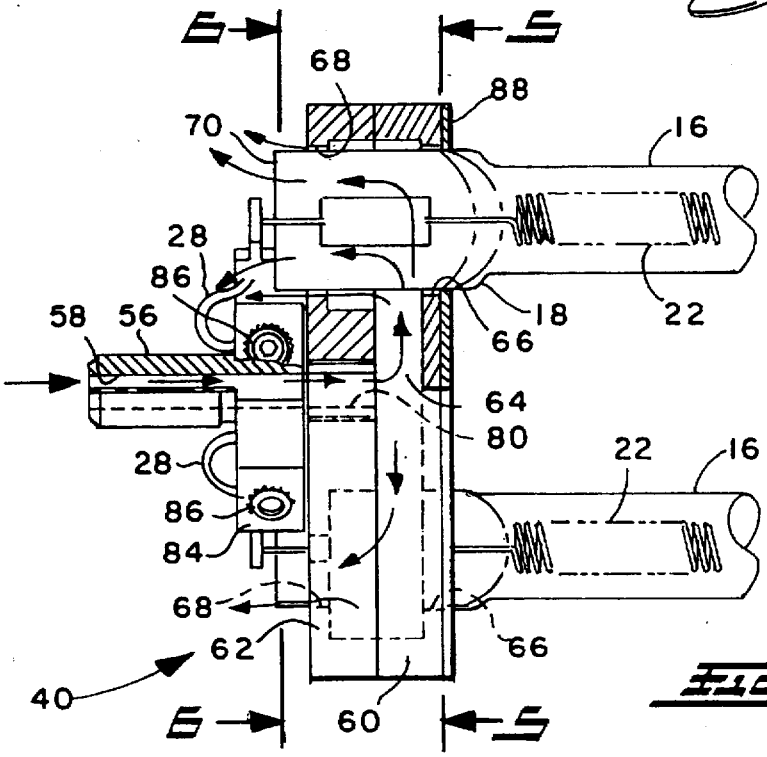
FIG. 4 is a cross-sectional side view of the socket assembly.

The connector member 42, more fully illustrated in FIG. 3, is preferably constructed from a conductive material such as brass. An electrical power conductor 44 is connected to a suitable power source and to the brass connector member 42 by a set screw 46. The power conductor 44 energizes the connector member 42. Connector member 42 includes a threaded opening 41 therein which is used to mount the heater assembly 12 within the cylindrical passageway 31. The use of bolt 45 provides for alignment of the heater assembly 12 with cylindrical passageway 31 and allows for ease of reinsertion of the heater assembly 12 into cylindrical passageway 31 after lamp replacement. The bolt 45 is nonconductive and supports connector member 42 on housing 36. Use of a non-conductive bolt 45 to support connector member 42 prevents stray electrical currents from passing from the conductive connector member 42 to housing 36 and electrically isolates heater assembly 12 from the housing 36. The connector member 42 includes a passageway 48 therein which includes an inlet 50 to which a conduit 52 is connected. The conduit 52 is connected to a suitable supply of cooling fluid such as air or inert gas. The passageway 48 includes an exit 54 which is in the form of a female plug entrance which is adapted to receive a mating male plug connector therein.

The lamp socket 40 includes a male plug connector 56 having a fluid passageway 58 disposed therein. The male plug 56 is adapted to be received within the female plug entrance 54 on the connector member 42 to position passageway 48 in fluid communication with passageway 58 in the socket 40. The connector member 42 is adapted to provide for the flow of cooling fluid from fluid passageway 48 to the fluid passageway 58. The lamp socket 40 includes a pair of substantially parallel side walls or side plates 60 and 62 which cooperate to define a manifold 64 therebetween. The side plates 60,62 are preferably formed from an electrically non-conductive material such as mica to prevent passage of stray electrical currents therethrough. The first side plate 60 includes a plurality of openings 66 disposed therein and the second side plate 62 includes a plurality of openings 68 located therein. Each of the openings 66 in the first side plate 60 is aligned with an opening 68 in the second side plate 62 to enable a base portion 18 of the lamps 14 to pass through the aligned openings 66 and 68 and be supported thereby with an end 70 of the base portion disposed adjacent to the second side plate 62 outside of manifold 64.

Figure 5:
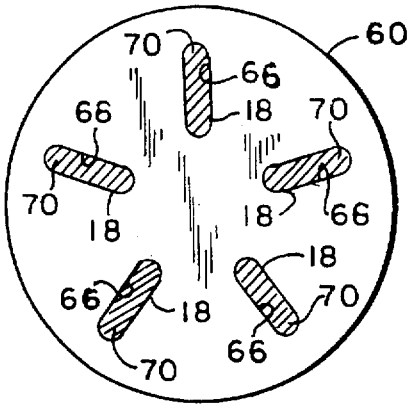
FIG. 5 is a view of the socket assembly taken approximately along the lines 5—5 of FIG. 4.
Figure 6:
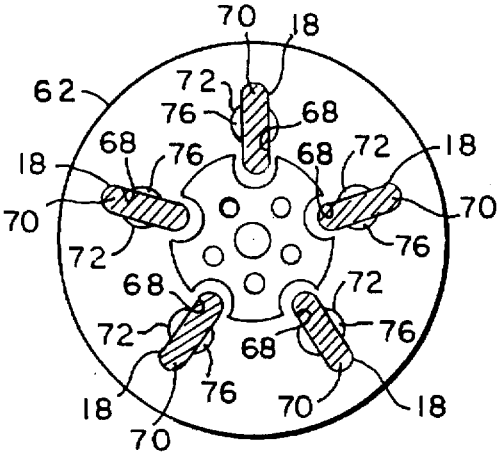
FIG. 6 is a view of the socket assembly taken approximately along the lines of 6—6 of FIG. 4.

The openings 66 in the first side plate 60 have a cross-sectional configuration, as is more fully illustrated in FIG. 5 which is substantially identical to and equal in size to the cross-sectional configuration of the portion of the base portion 18 which is supported therein. This enables the openings 66 in the first side plate 60 to engage with the base portion 18 of the lamps 14 to in part support the lamp 14 in heater assembly 12. The openings 68 in the second side plate 62 have a cross-sectional configuration which is similar to but larger in area than the cross-sectional configuration of the base portion 18 which is supported within each of the openings 68 in the second side plate 62. As is more fully illustrated in FIG. 6, each of the openings 68 in the second side plate 62 includes portions 70 and 74 which have a cross-sectional configuration which is substantially identical and equal in size to the portion of the lamp base portion which is disposed contiguous thereto to in part support the base portion 18 of the lamp 14 within the opening 68 in the second side wall 62. Each of the openings 68 additionally include a portion 72 which has a cross-sectional configuration which is different and greater in area than the portion of the lamp base portion 18 which is disposed adjacent thereto. The portion 72 of each opening 68 is spaced apart from the portion of the lamp base 18 disposed therein to define an exit passageway 76 from the manifold 64.

When the lamp socket 40 is engaged in connector 42, cooling fluid is directed through the conduit 52 and the passageway 48 located within the connector 42 to the passageway 58 located in the male plug 56 on the socket 40. The fluid passageway 58 communicates with an inlet 80 disposed in the second side wall 62 to provide for the flow of cooling fluid from the passageway 58, through inlet 80 into the manifold 64 in which the base portions 18 of the lamps 14 are supported. The cooling fluid creates a positive pressure within manifold 64, cools the base portions 18 of the lamp 14 disposed within the manifold 64 and exits from the manifold 64 through the exit passageways 76 in openings 68 in the second side wall 62. When the cooling fluid passes through the exit passageways 76, the cooling fluid is forced into close proximity with the base portion 18 of each of the lamps 14 to effect efficient cooling of the base portions 18 of the lamps 14. The openings 66 in the first side plate 60 form a relatively tight fit with the base portion 18 of the lamp 14 which is supported therein to prevent the flow of cooling fluid from the manifold 64 out of the openings 66 and into engagement with the lamps 14. The flow of cooling fluid through the socket 40 is directionally controlled by the passageway 58, the manifold 64 and the exit passageways 76 to provide for efficient cooling of the base portions 18 of each of the lamps 14 by forcing the cooling fluid into close proximity with the base portions 18 to effectively cool the base portions of each of the lamps 14. The cooling fluid passing through the socket assemblies 20 provides supplemental lamp end cooling for removing conducted energy emanating from the tungsten filaments 22 of the quartz halogen infrared lamps 14 which are at approximately 2,500 degrees Centigrade.

Electrical energy is directed to the power conductor 44 to energize conductive connector member 42. The male plug 56 of socket 40 is constructed from a conductive material such as brass and includes an annular collar 84. A plurality of conductors 28 are connected at one end to the annular collar 84 and at the opposite end to the lead wire 26 extending from the base portion 18 of each of the lamps 14 adjacent to the side plate 62 to effect energization of the lamps 14. A plurality of set screws 86 are provided in annular collar 84 for securing one end of each of the conductors 28 to the annular collar 84. The electrical power conductor 44 energizes conductive member 42 which in turn energizes annular collar 84 which then directs electrical energy through the lamp conductor wires 28 to the lead wire 26 of each of the lamps 14.

An infrared reflector 88 can be disposed on the outside surface of the first side plate 60 facing the lamp portion 16 of each of the lamps 14. The infrared reflector 88 reflects infrared energy generated by the lamps 14 away from the socket assemblies 20 to minimize the heating of the socket assemblies 20 by infrared energy generated by the lamps 14. The infrared reflector 88 acts to redirect any incidental or co-incidental infrared energy from striking the socket assemblies 20.

Figure 8:
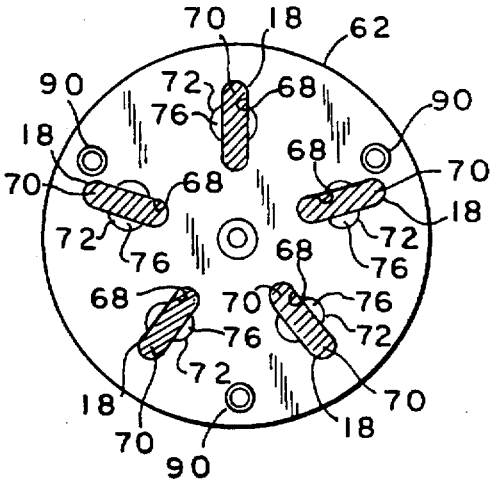
FIG. 8 is a view of the socket assembly of FIG. 7 taken approximately along the lines 8—8 of FIG. 7.
Figure 7:
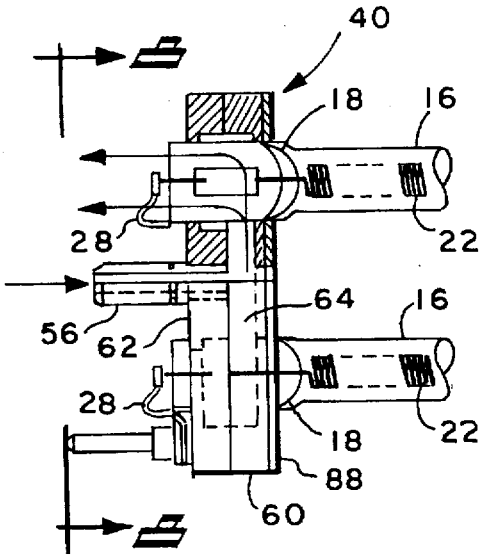
FIG. 7 is a side view of a alternate embodiment of the socket assembly of the present invention.

FIGS. 7 and 8 illustrate and alternate embodiment of the socket 40 which includes a plurality of banana plugs 90 for energizing the lamps 14. In this embodiment like reference numbers are utilized as with FIGS. 1–6 to indicate similar parts. The banana plugs 90 are particularly useful in three-phase or other polyphase applications. As is illustrated in FIG. 7, the banana plugs 90 are secured to the second side plate 62 and conductors 28 extend between the lamp lead wires 26 and the banana plug 90. Suitable power conductors, not illustrated, can be connected to the banana plugs to effect energization of conductors 28 and lamps 14. In this embodiment of the invention, a connector similar to connector 42 can be utilized to engage the socket 40 of FIG. 7 and to provide a flow of cooling fluid to the manifold 64. However, due to the use of the banana plugs 90 it is not necessary to energize the connector and the connector could be constructed from a non-conductive material. In this embodiment, the connector would provide a flow of cooling fluid from a source of cooling fluid into fluid passageway 58 and the manifold 64 to cool the base portions 18 of lamps 14 as described hereinbefore.

FIG. 9 discloses a schematic illustration of a control system for controlling the flow of cooling fluid through the socket assemblies 20 of the heater 10. The coolant gas is provided from a coolant gas supply 102 which is directed through a gas filter 104 and regulating valve 106 to a conduit 108 which is connected to the conduits 52 which direct the flow of cooling fluid through the socket assemblies 20. An electrical control 100 provides power on the electrical conductors 44 to effect energization of the lamps 14.

Through experimentation it has been found that a coolant gas flow rate of approximately 0.5 SCFM (Standard Cubic Feet per Minute) per lamp is adequate for maintaining a lamp base temperature below 350 degrees Centigrade for quartz halogen infrared lamps having a rating of 2000 watts. The supply of coolant fluid to cool the base portions 18 is critical in preventing overheating of the base portions 18 of the lamps 14 and assures long life of the quartz halogen infrared lamps. A coolant gas pressure switch 110 is connected to conduit 108 to monitor the coolant gas pressure supplied to cool the socket assemblies 20 and base portions 18 of the lamps 14. The coolant gas pressure switch 110 is connected to control 100 by conductors 112. The coolant gas pressure switch 110 monitors the gas pressure in the conduit 108 and sends a signal to the electrical control 100 to de-energize lamps 14 when the gas pressure falls below a predetermined value which in the preferred embodiment indicates a coolant gas flow rate of less than 0.5 SCFM per lamp. De-energization of lamps 14 when the coolant fluid flow drops below a predetermined volume protects the lamps 14 from overheating and assures long lamp life. Alternatively, the temperature of the base portion 18 of the lamps can be monitored utilizing a thermocouple or similar temperature-sensing device which would actuate the control 100 to de-energize the lamps and heater assembly 12 in the event that a temperature in excess of a predetermined value was sensed in the socket assembly 20 adjacent the base portion 18 of lamps 14.

From the foregoing it should be apparent that the new and improved heater assembly 12 for supporting and energizing a plurality of heating lamps 14 each of which includes a lamp portion 16 and a base portion 18 having one end which is connected to a power conductor 28 has been provided. The heater assembly includes a socket assembly 20 including first and second substantially parallel side plates 60, 62 which are connected together to define a manifold 64 therebetween. The first and second side plates each include a plurality of openings 66, 68, respectively, for receiving a base portion 18 of a lamp therein. Each of the openings 66 in the first side plate are aligned with an opening 68 in the second side plate 62 to allow a base portion 18 of each lamp 14 to pass through an opening 66 in the first side plate 60 and an aligned opening 68 in the second side plate 62 with one end 70 of the base portion 18 disposed adjacent to the second side plate 62 outside of manifold 64. The openings 66 in the first side plate have a cross-sectional configuration which is substantially identical and equal in size to the cross-sectional configuration of the portion of the base portion 18 which is disposed therein. Each of the heating lamps 14 is supported by the openings 66, 68 in the first and second side plates 60, 62 with the base portion 18 of each lamp being disposed in the manifold 64 and the one end 70 of each base portion 18 extending through an opening 68 in the second side plate 62 and being supported adjacent to the second side plate 62. The openings 68 in the second side plate 62 have a cross-sectional configuration which is similar to and larger in area than the cross-sectional configuration of the socket portion which is disposed therein with the difference in the cross-sectional area of the base portion 18 of the lamp and the cross-sectional area of the openings 68 in the second side plate 62 providing exit passageways 76 from the manifold 64. An inlet 80 is provided for directing a source cooling fluid into the manifold 64 with the cooling fluid flowing into the manifold 64 to cool the base portions 18 of the heating lamps 14 located in the manifold 64 with the cooling fluid flowing from the manifold 64 around the base portions 18 of the heating lamps 14 and through the exit passageways 76 in the openings 68 in the second side plate 62 to further cool the base portions 18 of each of the lamps. The exits passageways 76 force the cooling fluid into close proximity with the base portions 18 to efficiently cool the base portions 18 of the lamp 14. Conductors 28 are provided to connect the lead wires 26 of each of the base portions 18 of each of the lamps 14 adjacent to the second side plate 62 to effect energization of the lamps 14.

What we claim is:

1. A heater assembly for supporting and energizing a plurality of heating lamps each of which include a lamp portion and a base portion having one end which is connected to a power conductor comprising a socket assembly including first and second side plates which are connected together to define a manifold therebetween, said first and second side plates each including a plurality of openings therein for receiving a base portion of a lamp therein, each of said openings in said first side plate being aligned with an opening in said second side plate to allow a base portion of each lamp to pass through an opening in said first side plate and an aligned opening in said second side plate with said one end of the base portion disposed adjacent to said second side plate, said openings in said first side plate having a cross-sectional configuration which is substantially identical and equal in size to the cross-sectional configuration of the portion of the base portion which is disposed therein, each of said heating lamps being supported by said openings in said first and second side plates with the base portion of each lamp being disposed in said manifold and the one end of each base portion extending through an opening in said second side plate and being supported adjacent to said second side plate outside of said manifold, said openings in said second side plate having a cross-sectional configuration which is similar to and larger in area than the cross-sectional configuration of the base portion which is disposed therein, the difference in the cross-sectional area of the base portion of the lamp disposed within said opening in said second side plate and the cross-sectional area of the openings in said second side plate providing exit passageways from said manifold, an inlet for directing a source of cooling fluid into said manifold, said cooling fluid flowing into said manifold to cool the base portions of the heating lamps located in said manifold, said cooling fluid flowing from said manifold around the base portions of the heating lamps and through said exit passageways in said openings in said second side plate to further cool the base portions of the lamps and conductor means connected to the one end of each of the base portions of each heating lamp adjacent said second side plate.

2. A heater assembly as defined in claim 1 wherein said inlet is located in said second side plate and further including connector means connected to said inlet in said second side plate, said connector means including a fluid passageway therein for directing a source of cooling fluid through said inlet to said manifold.

3. A heater assembly as defined in claim 2 further including a connector member having a fluid passageway therein one end of which is adapted to be connected to a source of cooling fluid and the other end of which is connected to said connector means to direct cooling fluid from said source of cooling fluid, through said fluid passageway in said connector member, through said fluid passageway in said connector means to said inlet of said manifold, through said manifold and out of said exit passageways disposed in said openings located in said second side plate.

4. A heater assembly as defined in claim 3 wherein said connector member is formed from a conductive material, a power source is connected to said connector member to energize said connector member and further including a plurality of power conductors connected to said connector member, each of said power conductors extending from said connector member and connected to the one end of one of the base portions of one of the lamps located adjacent said second side plate to effect energization of the heating lamps.

5. A heater assembly as defined in claim 4 further including a non-conductive mounting means for engaging with and supporting said connector member which is formed from a conductive material.

6. A heater assembly as defined in claim 4 further including a heating chamber formed from an inert material surrounding the lamp portions of the heating lamps, said heating chamber having an inlet for directing a fluid to be heated into said heating chamber and an outlet for directing fluid from said heating chamber after the fluid to be heated has been heated by the heating lamps in said heating chamber.

7. A heater assembly as defined in claim 1 further including an infrared reflective means located on said first side plate facing the lamp portion of said heater lamps for reflecting infrared heat from said lamp portions away from said socket assembly.

8. A heater assembly as defined in claim 1 wherein said openings in said second side plate which have a similar cross-sectional configuration as the portion of the base portion disposed therein each include at least a first portion which has a cross-sectional configuration which is substantially identical to the portion of the base portion which is disposed contiguous thereto and a second portion which has a cross-sectional configuration which is different and greater in area than the portion of the base portion which is disposed adjacent thereto, said second portion of each of said openings and the portion of the base portion which is disposed adjacent thereto defining said exit passageways from said manifold for passing said cooling fluid from said manifold in forced proximity to the base portion of each of the lamps to effect efficient cooling of the base portion of the lamps.

9. A heater assembly as defined in claim 8 wherein each of said openings in said second side plate further includes a third portion having a cross-sectional configuration which is substantially identical with the cross-sectional configuration of the portion of the base portion of the lamp which is disposed contiguous thereto, said first and third portions of said openings in said second side plate in part supporting the heating lamps.

10. A heater assembly for supporting and energizing a heating lamp which includes a lamp portion and a base portion having one end which is connected to a power conductor comprising a socket assembly including first and second side plates which are connected together to define a manifold therebetween, said first and second side plates each including an opening therein for receiving a base portion of a lamp therein, said opening in said first side plate being aligned with said opening in said second side plate to allow the base portion of the lamp to be supported in said opening in said first side plate and said aligned opening in said second side plate with said one end of the base portion disposed adjacent to said second side plate outside of said manifold, said opening in said first side plate having a cross-sectional configuration which is substantially identical and equal in size to the cross-sectional configuration of the portion of the base portion which is disposed and supported therein, said heating lamp being supported by said openings in said first and second side plates with the base portion of said lamp being disposed in said manifold and the one end of the base portion extending through said opening in said second side plate and being supported adjacent to said second side plate, said opening in said second side plate having a cross-sectional configuration which is similar to and larger in area than the cross-sectional configuration of the base portion of the lamp which is disposed and supported therein, the difference in the cross-sectional area of the base portion of the lamp which is supported in said opening in said second side plate and the cross-sectional area of the opening in said second side plate providing an exit passageway from said manifold, an inlet therein for directing a source of cooling fluid into said manifold, said cooling fluid flowing into said manifold to cool the base portion of the heating lamp located in said manifold, said cooling fluid flowing from said manifold around the base portion of the heating lamp through said exit passageway in said opening in said second side plate in forced proximity to the base portion to further cool the base portion of the lamp and conductor means connected to the one end of the base portion of the heating lamp adjacent said second side plate.

11. A heater assembly as defined in claim 10 wherein said inlet is located in said second side plate and further including connector means connected to said inlet in said second side plate, said connector means including a fluid passageway therein for directing a source of cooling fluid to said manifold.

12. A heater assembly as defined in claim 11 further including a connector member having a fluid passageway therein one end of which is adapted to be connected to a source of cooling fluid and the other end of which is connected to said connector means to direct cooling fluid from said source of cooling fluid through said fluid passageway in said connector member, through said fluid passageway in said connector means to said inlet of said manifold, through said manifold and out of said exit passageway disposed in said opening located in said second side plate.

13. A heater assembly as defined in claim 12 wherein said connector member is formed from a conductive material, a power source is connected to said connector member to energize said connector member and further including a power conductor connected to said connector member and to the one end of the base portion of the lamp located adjacent said second side plate to effect energization of the heating lamp.

14. A heater assembly as defined in claim 13 further including a non-conductive mounting means for engaging with and supporting said connector member which is formed from a conductive material.

15. A heater assembly as defined in claim 13 further including a heating chamber formed from an inert material surrounding the lamp portion of the heating lamp, said heating chamber having an inlet for directing a fluid to be heated into said heating chamber and an outlet for directing fluid from said heating chamber after the fluid to be heated is heated by the heating lamp in said heating chamber.

16. A heater assembly as defined in claim 10 further including an infrared reflective means located on said first side plate facing the lamp portion of the heater lamp for reflecting infrared heat from the lamp portion away from said socket assembly.

17. A heater assembly as defined in claim 10 wherein said opening in said second side plate which has a similar cross-sectional configuration as the portion of the lamp base portion disposed therein includes at least a first portion which has a cross-sectional configuration which is substantially identical to the portion of the base portion which is disposed contiguous thereto and a second portion which has a cross-sectional configuration which is different and greater in area than the portion of the base portion which is disposed adjacent thereto, said second portion of said opening and the portion of the base portion which is disposed adjacent thereto defining said exit passageway from said manifold for passing said cooling fluid from said manifold in forced proximity to the base portion of the lamp to effect efficient cooling of the base portion of the lamp.

18. A heater assembly as defined in claim 17 wherein said opening in said second side plate further includes a third portion having a cross-sectional configuration which is substantially identical with the cross-sectional configuration of the portion of the base portion of the lamp which is disposed contiguous thereto, said first and third portions of said opening in said second side plate in part supporting the heating lamp.

19. A heater assembly as defined in claim 10 wherein said first side plate is substantially parallel to said second side plate.

* * * * *